US007905388B2

(12) United States Patent
Bowman

(10) Patent No.: US 7,905,388 B2
(45) Date of Patent: Mar. 15, 2011

(54) PRE-LINED RIGID SET-UP BOX

(75) Inventor: Linden H. Bowman, Ellicott City, MD (US)

(73) Assignee: Lindy Bowman Company, Elkridge, MD (US)

( * ) Notice: Subject to any disclaimer, the term of this patent is extended or adjusted under 35 U.S.C. 154(b) by 1522 days.

(21) Appl. No.: 11/008,926

(22) Filed: Dec. 13, 2004

(65) Prior Publication Data

US 2006/0124711 A1 Jun. 15, 2006

(51) Int. Cl.
*B65D 25/34* (2006.01)
*B65D 43/22* (2006.01)

(52) U.S. Cl. ..... 229/116.5; 229/125.38; 229/122.34

(58) Field of Classification Search ..... 229/125.38, 229/116.5, 122.34, 87.18, 923, 125.22, 922, 229/183, 104; 217/66
See application file for complete search history.

(56) References Cited

U.S. PATENT DOCUMENTS

| | | | | | |
|---|---|---|---|---|---|
| 687,643 | A | | 11/1901 | Megloughlin et al. | |
| 963,313 | A | * | 7/1910 | Nack | 229/103.3 |
| 1,155,686 | A | * | 10/1915 | Rhodes | 229/125.38 |
| 1,495,955 | A | * | 5/1924 | Inglis | 229/122 |
| 1,922,354 | A | * | 8/1933 | Burke | 229/125.22 |
| 2,003,326 | A | * | 6/1935 | Wellman | 229/109 |
| 2,453,920 | A | * | 11/1948 | Kysela | 206/232 |
| 2,744,676 | A | | 5/1956 | Sealy | |
| 2,771,237 | A | * | 11/1956 | Philipson | 229/125.22 |
| 3,114,300 | A | | 12/1963 | Bianchi | |
| 3,495,762 | A | | 2/1970 | Verbic | |
| 4,571,232 | A | | 2/1986 | Diehl | |
| 4,798,290 | A | * | 1/1989 | Bradford | 206/721 |
| 4,932,556 | A | | 6/1990 | Hui et al. | |
| 5,441,348 | A | | 8/1995 | Valentino | |
| 5,497,876 | A | * | 3/1996 | Fleming | 206/232 |
| 5,878,945 | A | | 3/1999 | Weder | |
| 5,989,171 | A | | 11/1999 | Hirschey et al. | |
| 6,305,600 | B1 | | 10/2001 | Hirschey et al. | |
| 6,601,757 | B2 | | 8/2003 | Bowman | |
| 6,604,674 | B1 | | 8/2003 | Bowman | |
| 2001/0032875 | A1 | | 10/2001 | Matatall et al. | |

OTHER PUBLICATIONS

WWW.CLIMAXPKG.COM, Climax Manufacturing Company, Packaging Divison.

* cited by examiner

*Primary Examiner* — Nathan J Newhouse
*Assistant Examiner* — Christopher Demeree
(74) *Attorney, Agent, or Firm* — Cahn & Samuels LLP

(57) ABSTRACT

An container with including a ribbon, a lid, and a container base including a ribbon channel and ribbon feedthroughs, a covering floor panel, a ribbon disposed within the channel and extending through the feedthroughs, a tissue paper liner with a flap affixed between the container base and the floor panel where the tissue paper covers a item in the box and the ribbon is tied over the tissue paper.

16 Claims, 4 Drawing Sheets

PRE-LINED RIGID SET-UP BOX

FIELD OF THE INVENTION

The present invention relates to improvements in lined, rigid, set-up boxes used particularly for gift packaging.

BACKGROUND OF THE INVENTION

As discussed in the inventor's previous patent, U.S. Pat. No. 6,601,757, rigid, set up gift boxes are popular in the retail trades and for home use. Because the present invention provides an enhancement to the disclosed rigid setup box structure described in that patent, the content thereof is incorporated by reference herein in its entirety, including its recitation of the problems in the prior art.

Many retail establishments, particularly those involved with the sale of high-quality goods, employ rigid set up boxes. For example, in the upscale clothing industry, such boxes often are customized to incorporate the retailer's trademark, name, crest, or other identifying indicia. A retailer, therefore, must maintain an inventory of boxes in assorted sizes to accommodate a range of differently sized articles. Typically, in packaging/gift wrapping an item in a rigid set up box, the item will be covered or wrapped in one or more sheets of tissue paper. That tissue paper may itself be secured about the enclosed item with a seal or ribbon prior to closing the box with its lid.

The wrapping of items in tissue paper may prove to be challenging and time consuming, especially when seeking to present a professional and neat appearance. As anyone with experience handling tissue paper knows, at best, it is an awkward process. Tissue paper typically comes in a standard one-size-fits-all sheet. However, the dimensions of many rigid set up boxes or other gift containers do not correspond to the length or width of such standard tissue paper sheets. Furthermore, where the rigid set-up box features design elements such as those illustrated in U.S. Pat. No. 6,601,757, a retailer will be compelled to use white tissue paper or maintain multiple tissue paper bundles/reams in an array of colors, in order to approximate color coordination between the box design and the tissue paper. Likewise, where tissue paper features a repeating retailer or manufacturer's logo, positioning and coordination of the tissue paper on the item with respect to the box can prove challenging and labor intensive. Particularly in the context wrapping soft articles such as small clothing items, maintaining uniformity and alignment can be difficult.

The prior art contains constructs made in attempt to overcome or assist in resolving these problems. Such attempts include pre-packaging and/or pre-attaching tissue paper liners in rigid set up boxes. However, problems persist due to the activity associated with securing the tissue paper about irregular items due to the relative fragility of the tissue paper. If not manipulated carefully, the tissue paper can be torn during the wrapping process. Even where the item is wrapped successfully, that is, neatly and aligned within the set-up box, if its size does not correspond to the interior dimensions of the box, during transport, the wrapped item can move independently within the box. Such movement may lead to damage of the item itself but more commonly, will cause the wrapped item to become misaligned and the tissue paper compromised by tearing or wrinkling. Consequently, the gift presentation may be diminished.

Regardless of the efforts to overcome the tissue liner issues in the prior art, problems still persist.

SUMMARY OF THE INVENTION

It is an object of the present invention to overcome the foregoing problems with the prior art.

It is an object of the present invention to provide a more attractive, efficient and decorative rigid set up gift box than that provided by prior art constructions.

Another object of the present invention is to provide a rigid set up box with an integrated paper liner preferably of tissue paper.

Another object of the present invention is to provide a rigid set up box with integrated tissue paper flaps and a tissue paper securing ribbon.

It is yet a further object of this invention to provide an integrated rigid set up box combination that is at once time efficient and easily used.

Still another object of the present invention is to provide a relatively uncomplicated, manageable, gift presentation solution for a vendor and a gift giver.

It is a further object of this invention to provide a secure and attractive gift box liner for gifts that enhances a decorative presentation.

Yet a further stated but not final object of the invention is to provide a gift-wrapping alternative that, at once, provides an aesthetic, appealing, and decorative presentation of a gift with a minimum of effort, waste, and complexity.

These and other objects of the invention are satisfied by a gift container, combining: a container base defining an upper and lower surface; at least one set of inserts affixed to the upper surface of the base in a manner to provide a gap between the inserts to define a ribbon channel with a first end and a second end; a floor panel having an upper surface and a lower surface, said floor panel for overlying said ribbon channel and having a ribbon aperture substantially coinciding with each of said first and second ribbon channel ends, respectively; a sheet liner formed within said box base and dimensioned to cover said floor panel, said sheet liner defining a flap that is affixed between one of said inserts and said floor panel in a manner not to obstruct said ribbon aperture; and a ribbon extending along said ribbon channel through said ribbon aperture and dimensioned to extend over the sheet liner and be secured thereover.

Still other objects of the invention are satisfied by a method of using the above-described rigid set up box including the steps of placing a select item in the box container, folding the at sheet liner over the item, and tying the ribbon over the covered item.

In a nutshell, the invention contemplates the combination of a pre-sized sheet-like liner affixed to the interior of a set-up box for covering an item placed in and contained by the box container, and ribbon, all formable into an integrated, coordinated, decorative structure that assures a very easily assembled, neat, attractively decorated gift presentation that coincidentally provides a heightened level of confidence that the gift package will remain intact until opened by the recipient. Aesthetically, the invention minimizes work and stress typically required to obtain a desirable finished product. Practically, the gift giver invests no more time to make a neat and attractive presentation than that required to choose the appropriately decorated and sized box, open the lid and flip open the interior tissue paper flap, insert the gift item, cover the gift with the interior tissue paper flap, secure the tissue paper flap over the gift item with an interior ribbon, place the lid on the box and tie the exterior ribbon over the lid. Thus, the instant invention satisfies the primary advantages of neatness, convenience, efficiency, and resource conservation.

The invention may incorporate other features such as an integrated gift card as described and disclosed in my copending application Ser. No. 10/900,368 filed Jul. 28, 2004, entitled Gift Card Box, the content of which is incorporated herein by reference.

Clearly, the invention herein provides an expedient to the gift wrapping challenged, in the form of a lined gift box combination that maximizes wrapping ease while assuring compatible design/decoration selection and artistic flexibility and minimizing the risk of aesthetic selection errors (color, texture, thematic, etc.).

As used herein "substantially," "generally," and other words of degree are relative modifiers intended to indicate permissible variation from the characteristic so modified. It is not intended to be limited to the absolute value or characteristic which it modifies but rather possessing more of the physical or functional characteristic than its opposite, and preferably, approaching or approximating such a physical or functional characteristic.

In the following description, reference is made to the accompanying drawing, which is shown by way of illustration to the specific embodiments in which the invention may be practiced. The following illustrated embodiments are described in sufficient detail to enable those skilled in the art to practice the invention. It is to be understood that other embodiments may be utilized and that structural changes based on presently known structural and/or functional equivalents may be made without departing from the scope of the invention.

BRIEF DESCRIPTION OF THE DRAWINGS

Like reference numerals in the figures represent and refer to the same element or function throughout.

DETAILED DESCRIPTION OF THE INVENTION

Figure 1:
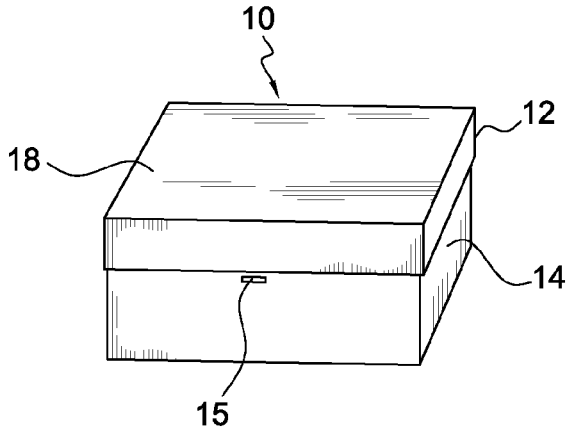
FIG. 1 is a perspective representative depiction of a box container according to one embodiment of the invention.
Figure 2:
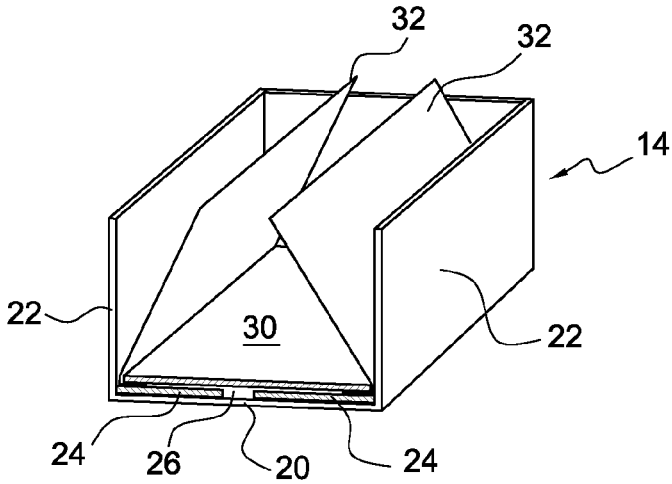
FIG. 2 is cutaway perspective view of the line gift box of the embodiment in FIG. 1.
Figure 3:
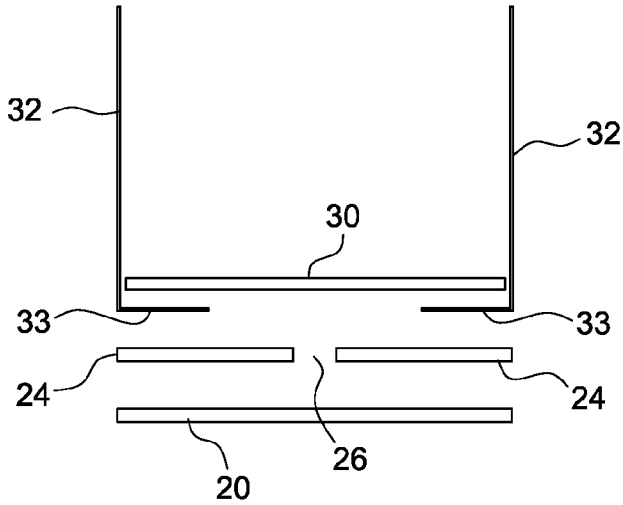
FIG. 3 is an diagrammatic assembly view of the bottom of the lined gift box base of the embodiment in FIG. 1.
Figure 4:
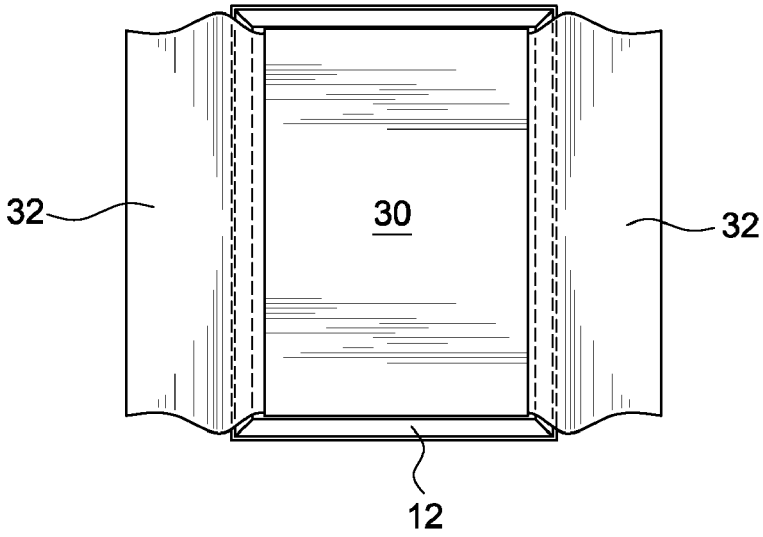
FIG. 4 is a top photographic view of a lined gift box base with both sheets of liner in an unfolded state of another embodiment of the invention.
Figure 5:
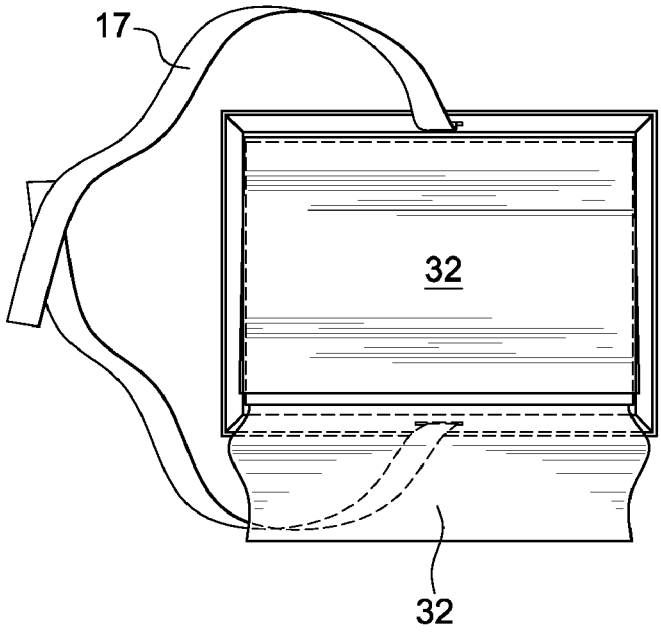
FIG. 5 is a top photographic view of the lined gift box base depicted in FIG. 4 with one liner sheet in an unfolded state.
Figure 6:
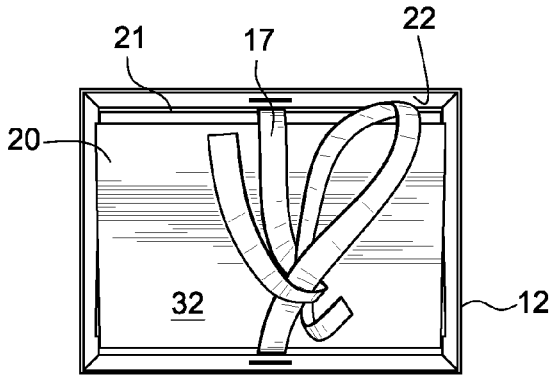
FIG. 6 is a top photographic view of the lined gift box base depicted in FIG. 4 with both liner sheets in a folded state within the base.
Figure 7:
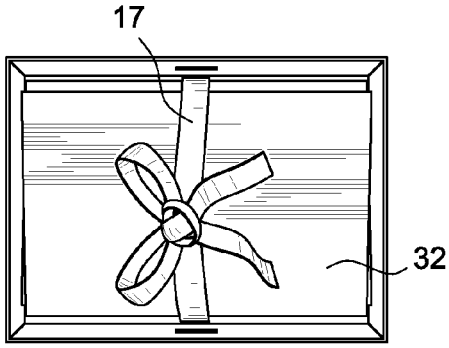
FIG. 7 is a top photographic view of the lined gift box base depicted in FIG. 4 covering a gift and having the integrated securing ribbon tied thereover.
Figure 8:
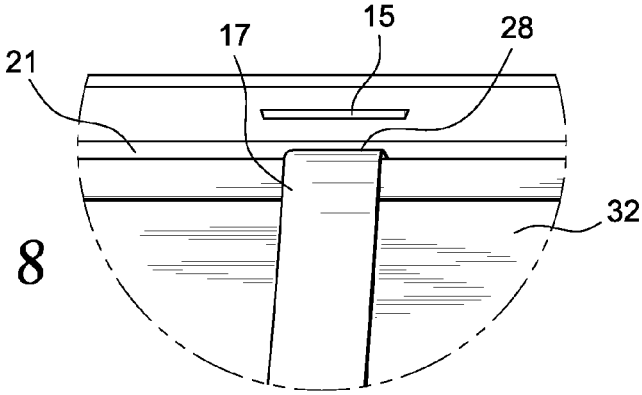
FIG. 8 is photographic view of a side detail of lined gift box base depicted in FIG. 4.
Figure 9:
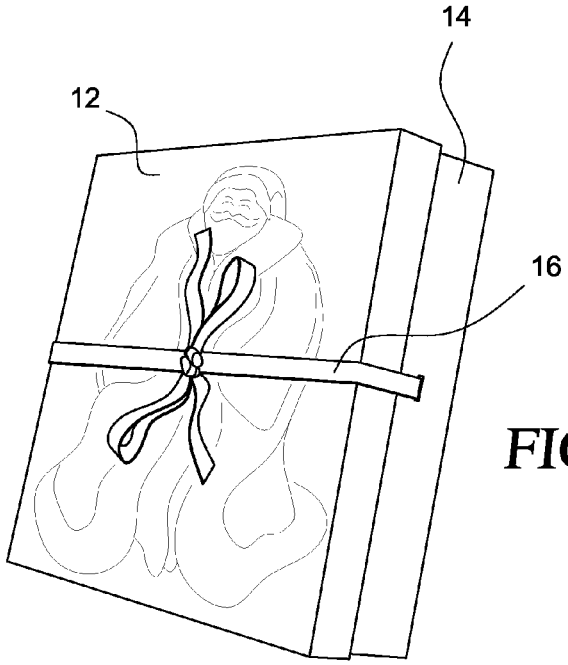
FIG. 9 is a perspective view of an assembled gift box according to the invention.
Figure 10:
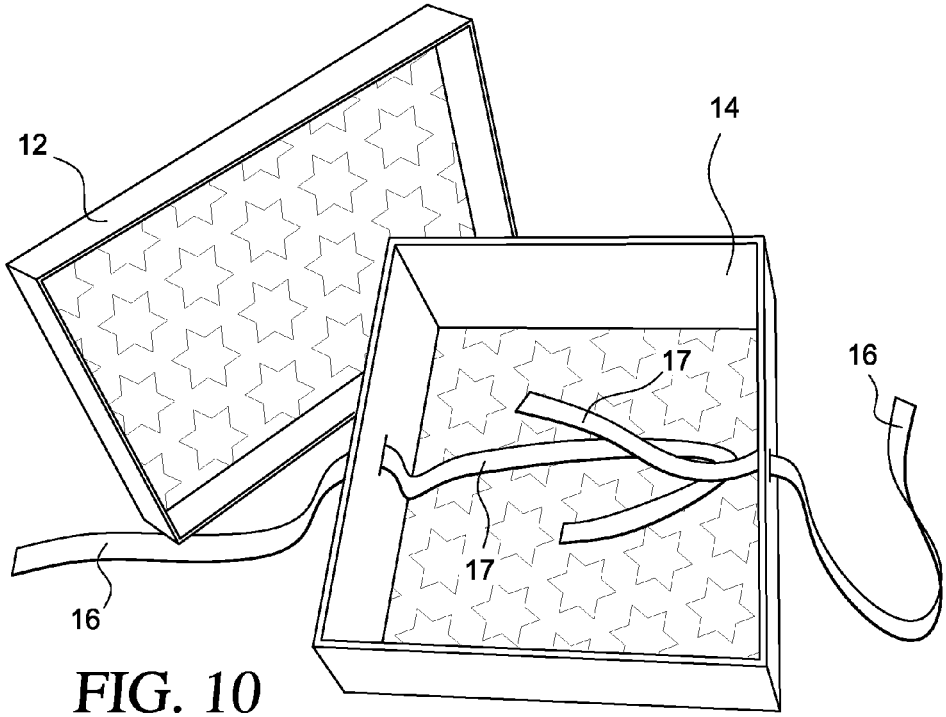
FIG. 10 is a perspective view of the interior of the box depicted in FIG. 9 showing thematically coordinated tissue paper and the interior ribbon.

Referring now to the figures and, in accordance with a first embodiment of the invention the exterior of an assembled rectangular gift box 10 is illustrated in FIG. 1. The FIG. 1 embodiment corresponds to the same exterior structure as the gift boxes depicted and described in U.S. Pat. No. 6,601,757, the content of which is incorporated by reference herein. The gift box 10 includes a rigid and strong lid 12, dimensionally complementary to rigid and strong box base container 14 to fit snugly thereover. The lid 12 and box container 14, are formed from a relatively heavy 550 GMS (grams per meter squared) grey board paper. The inside surface of the box includes a laminated No. 80 wood free paper (non-glossy) and the exterior is covered with high gloss, printed No. 110 art paper. The exterior surfaces typically incorporate selected colored, decorative, and/or thematic elements such as logos, names, and/or scenic or character depictions.

The box container 14 incorporates a base 20 (illustrated as rectangular) and vertically disposed side walls 22 about the perimeter of the base. A pair of cardboard inserts 24 is disposed on the upper surface of the base 20. The inserts 24 are sized to be alignable and substantially co-extensive with the interior border of the base 20 and are affixed, preferably glued, to the upper (interior) surface of the base in a manner to define a channel 26 between the two inserts for receiving the ribbons 16 and 17. The channel 26 extends between a pair of oppositely positioned ribbon floor slots 28 formed at the opposite ends of the channel. (See FIG. 8). Preferably, the ribbon floor slots 28 are each located proximate to a base of side walls 22 and have a width sufficient to accommodate the ribbons. Affixed above and covering the inserts 24 is a rigid floor panel 30 that dimensionally corresponds to the interior border of the base 20. In the embodiment of FIGS. 4-8, the width of floor panel 30 is slightly less than that of base 20 so as not to obstruct the ribbon floor slots 28. Referring to the structure of the side walls 22, the set of opposed sidewalls intersecting with the channel 26 each include a ribbon feedthrough slot 15 positioned above a corresponding ribbon floor slot 28 and preferably located at a distance below the upper wall edge to accommodate the sides of the lid 12. All of the slots 28 and 15 may be reinforced with a grommet. The floor panel 30 may or may not incorporate color, decorative, or thematic printing coordinated with that of the box exterior.

The floor panel also serves as an anchor for the pre-sized interior cover sheets 32. Each of the cover sheets 32, preferably, is sized to provide an attachment flap/flange 33 and a cover potion corresponding to the planar surface defined by the floor panel 30. The flap 33 is adhesively affixed between and to overlie the upper surface of the inserts 24 and to underlie the lower surface of the floor panel 30. In the preferred embodiment of the invention, the sheets 32 are tissue paper but may be formed of any thin, flexible material (e.g., paper or cloth) capable of covering an item and having a ribbon tied thereover. The cover sheets 32 preferably incorporate color, decorative, identification, and or thematic features corresponding to that of the gift box 10.

Referring to the ribbons, they too should be coordinated with the other elements to provide a maximum aesthetic presentation. In the context of structure, the interior ribbon 17 and exterior ribbon 16 of the invention are set in the channel 26 prior to the floor panel 30 being affixed to/glued on the inserts 26. Each end of the ribbons extends through the channel 26, through the floor slots 28 and into the box interior. The exterior ribbon 16, further, passes through the side wall slots 15. Upon placing the lid 12 on the box base 14, the ribbon 16 which projects from the container box at a point just below the edge of the lid side, is tied in a bow on the top of the lid to thereby establish the integrated rigid, decorative gift box 10 of the illustrated first embodiment of the invention. In one structural alternative, to increase consistency on packaging presentation, the segments of the ribbons 16 and 17 coextensive with the channel 26 may be affixed within the channel and/or to each other.

Although illustrated in a rectangular configuration, the invention may be in any form capable of acting as a container, e.g., elliptical, hexagonal, round, polyhedral, etc. The illustrated embodiment also depicts an opaque lid. It is however, within the purview of the present invention to incorporate attractive design features such as Fresnel, uneven surfaced, and/or even translucent or transparent panels to enhance the decorative effect of the invention. Such enhanced features integrated in the lid panel should possess sufficient rigidity and strength to meet the structural integrity objectives of the instant invention.

Another variation to the illustrated embodiments is to expand on the number of ribbon channels and ribbons. The illustrated embodiments depict a single ribbon channel to accommodate a single ribbon in the floor of the container. It is within the scope of the invention to include a plurality of channels and integrated ribbon inserts where desired for utilitarian and aesthetic reasons. The disclosure suggests that the ribbon be tied. However, it is within the scope of this invention to include ribbon portions that are removably adherable to one another (reusable adhesive, Velcro®, etc.) and may include a detachable preformed bow decoratively coordinated (color, texture, etc.) with the integrated ribbons.

In order to improve the reusability of a lined gift box in accordance with the invention, the ribbon may incorporate a flexible, reinforcing member such as wire to permit the ribbon to be smoothed out after use for subsequent uses.

Given the foregoing, it should be apparent that the specifically described embodiments are illustrative and not intended to be limiting. Furthermore, variations and modifications to the invention should now be apparent to a person having ordinary skill in the art. These variations and modifications are intended to fall within the scope and spirit of the invention as defined by the following claims.

I claim:

1. A gift container, comprising:

a container base defining an upper and lower surface;

at least one set of inserts affixed to the upper surface of the container base in a manner to provide a gap between the inserts to define a ribbon channel with a first end and a second end;

a floor panel having an upper surface and a lower surface, and at least a first and a second edge having, said floor panel for overlying said container base and said first and second edges having cooperating with said base to define a gap and establish said ribbon channel, a sheet liner formed within said container base and dimensioned to cover said floor panel, said sheet liner defining an attachment flap that is affixed between said container base inserts and said floor panel in a manner not to obstruct said ribbon channel.

2. The gift container according to claim 1 where the floor panel dimensionally corresponds to and substantially overlies the entire upper base surface.

3. The gift container according to claim 2 where the sheet liner is formed of tissue paper and substantially overlies the entire upper base surface.

4. The gift container according to claim 3 where there is a pair of matched inserts and there are two sheet liners, one each associated and affixed to one of the pair of the inserts.

5. The gift container according to claim 1 further comprising a lid, the base having side walls and ribbon apertures on opposite sides of the base in said side walls, a second ribbon extending through the channel, through the ribbon apertures in the base and the side wall apertures to be tieable over the lid.

6. The gift container of claim 1 further comprising coordinated decorative paper being adhered to the box container on the upper and lower floor surfaces and side walls thereof and to the lid on the upper and lower surfaces and the side wall portion thereof.

7. The gift container of claim 1 where the container is generally rectangular.

8. The method of using the gift container of claim 1 including the steps of placing a select item on the container floor panel, covering the select item with the sheet liner and securing the interior ribbon over the covered item.

9. An improved gift box combination including a lid and a container portion with a base covered with a floor panel substantially coextensive with the base, a plurality of inserts affixed to the upper surface of the container base defining a ribbon channel with a first and second ends for receiving and retaining a ribbon disposed between the base and the floor panel, ribbon feedthroughs formed proximate to floor panel in an uncovered portion of the base for ribbon communication with said first and second channel ends, at least one flexible cover sheet dimensioned to extend over the floor panel and to provide an attachment flap, said cover sheet flap being affixed between the base and the floor panel along an edge thereof, and a ribbon extending through the ribbon channel and securable over the flexible cover sheet.

10. The improved gift box combination of claim 9 where the flexible cover sheet is tissue paper.

11. The improved gift box combination of claim 9 further comprising a second flexible cover sheet with a flap that is affixed between the base and the floor panel along a second edge thereof.

12. The improved gift box combination of claim 11 where the cover sheets are disposed along opposite edges of the floor panel.

13. The improved gift box combination of claim 9 further comprising lid means for conforming to and dimensions to seat on and over the base.

14. The improved gift box combination of claim 13 where said lid including an integrated card portion.

15. The method of using the improved gift box claim 9 including the steps of placing a select item on the container floor panel, covering the select item with the flexible cover sheet and securing the ribbon over the covered item.

16. A gift container, comprising:

a container base defining an upper and lower surface;

at least one set of inserts affixed to the upper surface of the base in a manner to provide a gap between the inserts to define a ribbon channel with a first end and a second end;

a floor panel having an upper surface and a lower surface, said floor panel for overlying said container base and cooperating with said container base to establish said ribbon channel, and having a ribbon aperture substantially coinciding with each of said first and second ribbon channel ends, the width of said floor panel being slightly less than that of the container base floor panel and defining a first and second gap between said floor panel and said container base proximate to corresponding first and second ends of the ribbon channel so as not to obstruct the ribbon floor slots;

a sheet liner formed within said container base and dimensioned to cover said floor panel, said sheet liner defining an attachment flap that is affixed between one of said container base inserts and said floor panel in a manner not to obstruct said ribbon aperture; and a ribbon extending along said ribbon channel through said ribbon aperture and dimensioned to extend over the sheet liner and be secured thereover.

* * * * *